US008182298B1

(12) United States Patent
Lin

(10) Patent No.: US 8,182,298 B1
(45) Date of Patent: May 22, 2012

(54) PROBE CONNECTOR

(75) Inventor: Jui-Pin Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/102,067

(22) Filed: May 6, 2011

(51) Int. Cl.
*H01R 4/48* (2006.01)

(52) U.S. Cl. ..... 439/816

(58) Field of Classification Search ..... 439/816, 439/82, 839, 824, 482
See application file for complete search history.

(56) References Cited

U.S. PATENT DOCUMENTS 7,815,474 B1 * 10/2010 Lin et al. ..... 439/700
8,066,534 B1 * 11/2011 Lin ..... 439/700
2010/0267289 A1 * 10/2010 Urano ..... 439/733.1
2010/0330825 A1 * 12/2010 Fan ..... 439/82
* cited by examiner

*Primary Examiner* — Jean F Duverne
(74) *Attorney, Agent, or Firm* — Lin & Associates IP, Inc.

(57) ABSTRACT

A probe connector includes a base shell having a barrel of which a top edge has two opposite portions protruded upward to respectively form a pair of buckling arms each having a buckling bard protruded at a top end thereof. A probe pin has a support board of which two opposite ends define a buckling slot respectively and a middle is punched upward to form a touching portion. Two resisting arms are provided at two opposite side edges of the support board and inclined towards each other during extending downward. The probe pin is movably and removably coupled to the base shell with an elastic element assembled in the barrel and the touching portion. The buckling barbs pass through the bucking slots to block over the support board, the buckling arms are inserted in the buckling slots and the resisting arms abut against two opposite outsides of the barrel.

5 Claims, 3 Drawing Sheets

PROBE CONNECTOR

BACKGROUND OF THE INVENTION

1. Field of the Invention

The present invention relates to a connector, and more particularly to a probe connector.

2. The Related Art

A traditional probe connector includes a shell, an elastic element and a probe pin. The probe pin has a cylindrical base portion and a touching portion protruding upward from a middle of a top of the base portion. The shell is made of metal material, and has a hollow barrel looped from a metal plate and having a top end opened freely. In assembly, the elastic element is disposed in the barrel, and the base portion of the probe pin is inserted downward in the barrel, wherein two opposite ends of the elastic element abut against a bottom of the base portion and a bottom side of the barrel. Then an auxiliary jig is used to make a periphery edge of the top end of the barrel shrunk inward so as to block the base portion in the barrel. The touching portion projects out of the top end of the barrel for contacting a mating terminal.

However, after the base portion of the probe pin and the elastic element are assembled in the barrel, the periphery edge of the top end of the barrel needs be shrunk inward by the auxiliary jig. So the probe connector has a complicated assembly process, and accordingly, it is hard to disassemble the probe connector on account of the foregoing assembly manner.

SUMMARY OF THE INVENTION

An object of the present invention is to provide a probe connector. The probe connector includes a base shell having a barrel of which a bottom is sealed up by a base board and a top is opened freely. A receiving chamber is defined in the barrel. A top periphery edge of the barrel has two opposite portions protruded upward to respectively form a pair of buckling arms spaced from each other. Two top ends of each pair of buckling arms oppositely protrude sideward to form a pair of buckling barbs. An elastic element has a bottom end thereof inserted downward in the receiving chamber of the barrel and abutting against the base board. A top end of the elastic element stretches upward out of the barrel. A probe pin has a support board of which a middle is punched upward to form a cylindrical touching portion having a top sealed up and a bottom opened freely. A receiving space is accordingly defined in the touching portion. The support board has two opposite portions which are projected beyond two opposite sides of the touching portion define a buckling slot respectively. A pair of resisting arms is provided at two opposite side edges of the support board and inclined towards each other in process of extending downward. The probe pin is movably and removably coupled to the base shell with the top end of the elastic element being inserted in the receiving space and abutting against a top side of the receiving space, by means of each pair of buckling barbs passing through the corresponding bucking slot to make the pair of buckling arms inserted in the buckling slot for guiding the movement of the probe pin. The buckling barbs block over the support board to avoid the probe pin falling off from the base shell, and the resisting arms abut against two opposite outside faces of the barrel.

As described above, the probe connector of the present invention utilizes the resisting arms to resist against the two opposite outside faces of the barrel, and the buckling arms to be inserted in the buckling slot with the buckling barbs capable of blocking the support board, so as to make the probe pin movably and removably coupled to the base shell. So the probe connector can be easily assembled and disassembled.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 1:
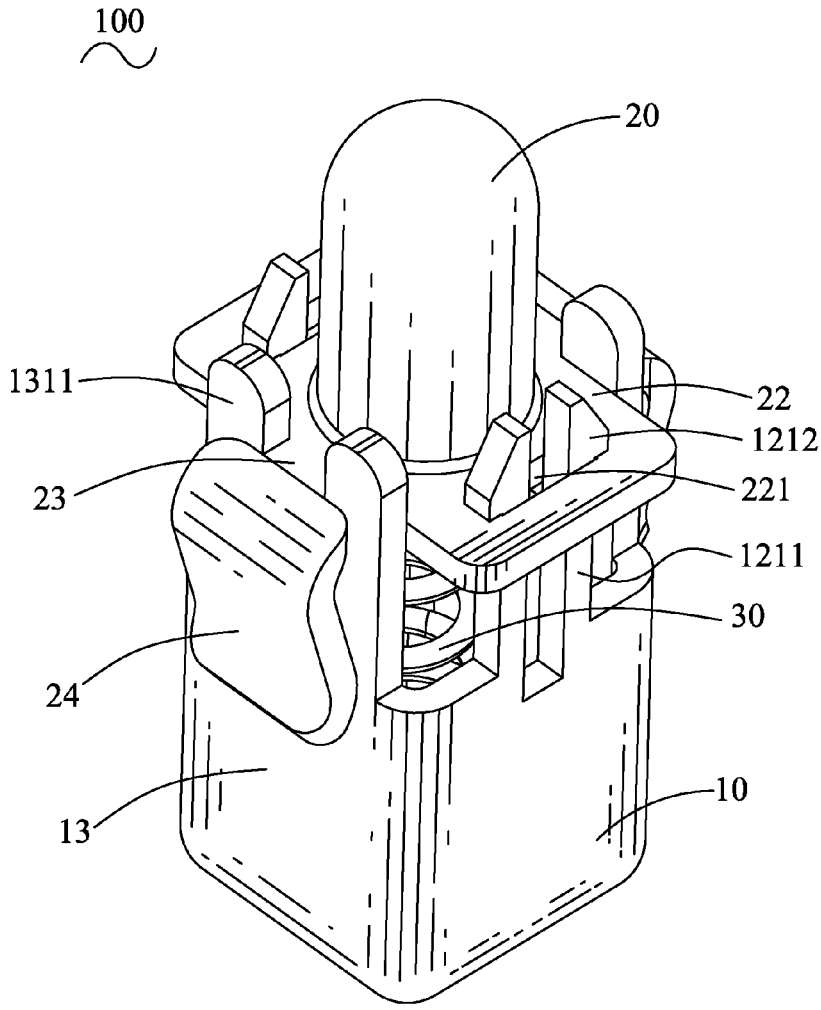
FIG. 1 is an assembled perspective view of a probe connector according to an embodiment of the present invention.

With reference to FIG. 1, a probe connector 100 according to an embodiment of the present invention includes a base shell 10, a probe pin 20 and an elastic element 30.

Figure 2:
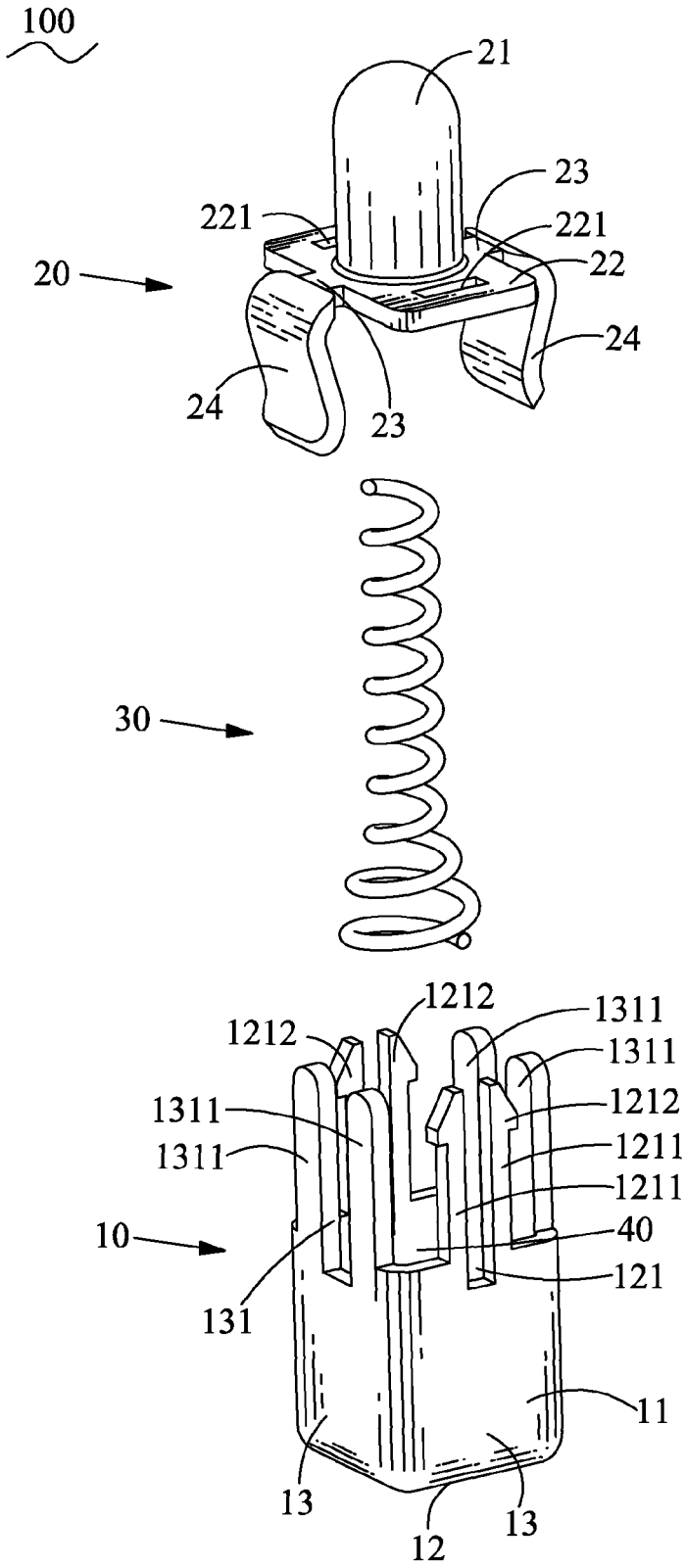
FIG. 2 is an exploded perspective view of the probe connector of FIG. 1.

Referring to FIG. 2, the base shell 10 is made of metal material and has a rectangular cylindrical barrel 11 of which a bottom is sealed up by a rectangular base board 12 and a top is opened freely. Four periphery edges of the base board 12 extend upward to form four side boards 13 connected together to define a receiving chamber 40 thereamong. Two opposite ones of the four side boards 13 each has a top edge thereof protruded upward to form a pair of buckling arms 1211 which are spaced from each other to have an elastic space 121 therebetween. The elastic space 121 is further spread downward to the corresponding side board 13. Two top ends of the pair of buckling arms 1211 oppositely protrude sideward to form a pair of buckling barbs 1212. Another two opposite side boards 13 each has a top edge thereof protruded upward to form a pair of restraining strips 1311 which are spaced from each other to have a restraining track 131 therebetween. The restraining track 131 is further spread downward to the corresponding side board 13.

Figure 3:
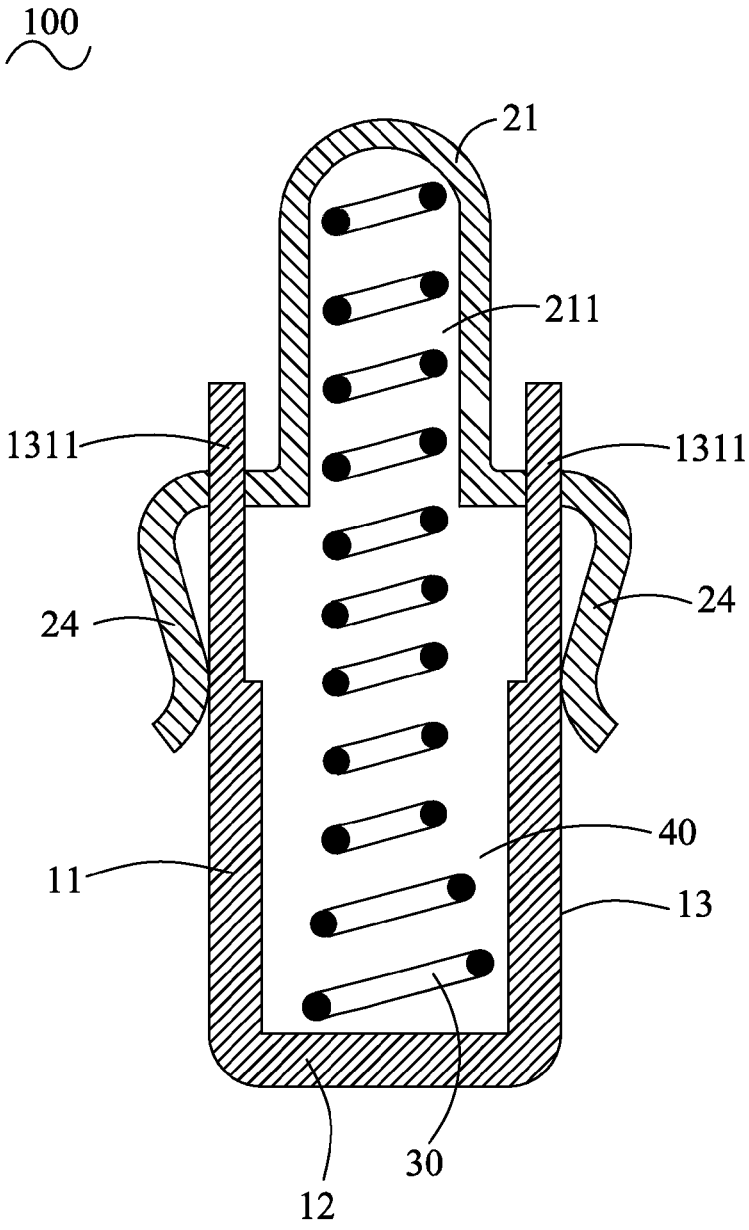
FIG. 3 is a cross-sectional view of the probe connector of FIG. 1.

Referring to FIG. 2 and FIG. 3, the probe pin 20 has a rectangular support board 22 of which a middle is punched upward and perpendicularly to the plane of the support board 22 to form a columned and hollow touching portion 21 having a top sealed up and a bottom opened freely. Accordingly, a receiving space 211 is formed in the touching portion 21 having a bottom thereof opened freely. Two opposite ends of the support board 22 projected beyond two opposite sides of the touching portion 21 each is provided with a buckling slot 221 vertically penetrating therethrough. Each middle of two opposite side edges of the support board 22 protrudes sideward to form a restraining ear 23 of which a distal end extends downward to form a resisting arm 24. The two resisting arms 24 are inclined towards each other in process of extending downward, and have two free ends thereof arched towards each other. In the embodiment, the elastic element 30 is a spring having one end greater than the other end in diameter.

Referring to FIGS. 1-3 again, when assembling the probe connector 100, one end of the elastic element 30 having a greater diameter is inserted downward in the receiving chamber 40 of the barrel 11 of the base shell 10 and abuts against the base board 12 of the barrel 10. The other end of the elastic element 30 stretches upward beyond the base shell 10. Then the probe pin 20 is movably and removably assembled onto the base shell 10, with the other end of the elastic element 30 being inserted in the receiving space 211 and abutting against a top side of the receiving space 211. The support board 22 is mounted among the buckling arms 1211 and the restraining strips 1311 to make the receiving space 211 face the receiving chamber 40, by means of each pair of buckling arms 1211 being pressed towards each other to make the buckling barbs 1212 pass through the corresponding bucking slot 221, and the restraining ears 23 being positioned in the restraining tracks 131 respectively with the resisting arms 24 elastically resisting against two corresponding side boards 13. Then the buckling arms 1211 are set free to make the buckling barbs 1212 located over the support board 22. The buckling barbs 1212 can grapple the support board 22 when the probe pin 20 moves upward to a certain extent under the elasticity action of the elastic element 30, so as to avoid the probe pin 20 falling off from the base shell 10.

When the touching portion 21 is pressed downward by a mating terminal (not shown) or set free from the mating terminal, the probe pin 20 moves downward under the press force of the mating terminal or moves upward under the elasticity action of the elastic element 30 by means of the guidance between the buckling arms 1211 and the buckling slot 221, and between the restraining ears 23 and the restraining strips 1311. The elastic element 30 utilizes the design of one end thereof being greater than the other end thereof in diameter to avoid the elastic element 30 slanting randomly in the receiving chamber 40 and the receiving space 211 during the movement of the probe pin 20, so as to ensure the steady movement of the probe pin 20 in use. Furthermore, the resisting arms 24 of the probe pin 20 always resist against the two corresponding side boards 13 of the base shell 10 in the process of the touching portion 32 being pressed by the mating terminal and set free from the mating terminal, so that effectively further ensures a steady movement of the probe pin 20 with respect to the base shell 10 and achieves a steadily electrical connection between the probe pin 20 and the base shell 10.

As described above, the probe connector 100 of the present invention utilizes the restraining ears 23 to be positioned between the corresponding restraining strips 1311 with the resisting arms 24 resisting against the two corresponding side boards 13, and the buckling arms 1211 to be inserted in the buckling slot 221 with the buckling barbs 1212 capable of blocking the support board 22, so as to make the probe pin 20 movably and removably coupled to the base shell 10. So the probe connector 100 can be easily assembled and disassembled.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A probe connector, comprising:

a base shell having a barrel of which a bottom is sealed up by a base board and a top is opened freely, a receiving chamber being defined in the barrel, a top periphery edge of the barrel having two opposite portions protruded upward to respectively form a pair of buckling arms spaced from each other, two top ends of each pair of buckling arms oppositely protruding sideward to form a pair of buckling barbs;

an elastic element having a bottom end thereof inserted downward in the receiving chamber of the barrel and abutting against the base board, a top end of the elastic element stretching upward out of the barrel; and a probe pin having a support board of which a middle is punched upward to form a cylindrical touching portion having a top sealed up and a bottom opened freely, a receiving space being accordingly defined in the touching portion, the support board having two opposite portions which are projected beyond two opposite sides of the touching portion define a buckling slot respectively, a pair of resisting arms being provided at two opposite side edges of the support board and inclined towards each other in process of extending downward, wherein the probe pin is movably and removably coupled to the base shell with the top end of the elastic element being inserted in the receiving space and abutting against a top side of the receiving space, by means of each pair of buckling barbs passing through the corresponding bucking slot to make the pair of buckling arms inserted in the buckling slot for guiding the movement of the probe pin, the buckling barbs block over the support board to avoid the probe pin falling off from the base shell, and the resisting arms abut against two opposite outside faces of the barrel.

2. The probe connector as claimed in claim 1, wherein the top periphery edge of the barrel have another two opposite portions protruded upward to respectively form a pair of restraining strips spaced from each other, each of the resisting arms is connected with the side edge of the support board by means of a restraining ear which is movably positioned between the pair of restraining strips.

3. The probe connector as claimed in claim 2, wherein the two resisting arms have two free ends thereof arched towards each other.

4. The probe connector as claimed in claim 2, wherein the two pairs of restraining strips are in line with each other perpendicular to the line in which the two pairs of buckling arms are aligned.

5. The probe connector as claimed in claim 1, wherein the elastic element is a spring having the bottom end greater than the top end in diameter.

* * * * *